United States Patent [19]

Pfefferle

[11] 4,239,499

[45] Dec. 16, 1980

[54] PRODUCTION OF A FUEL GAS AND SYNTHETIC NATURAL GAS FROM METHANOL

[75] Inventor: William C. Pfefferle, Middletown, N.J.

[73] Assignee: Engelhard Minerals and Chemicals Corporation, Iselin, N.J.

[21] Appl. No.: 851,661

[22] Filed: Nov. 15, 1977

Related U.S. Application Data

[63] Continuation of Ser. No. 599,863, Jul. 28, 1975, abandoned.

[51] Int. Cl.[3] ..... C01B 2/14

[52] U.S. Cl. ..... 48/197 R; 48/214 A; 260/449.6 M

[58] Field of Search ..... 48/197 R, 214 A, 214 R; 252/472, 466 PT; 260/449.6 M, 449 M

[56] References Cited

U.S. PATENT DOCUMENTS

| | | | |
|---|---|---|---|
| 3,379,505 | 4/1968 | Holmes et al. | 260/449 M |
| 3,429,679 | 2/1969 | Friedman et al. | 260/449 M |
| 3,511,624 | 5/1970 | Humphries et al. | 260/449 M |
| 3,898,057 | 8/1975 | Moller et al. | 48/197 R |
| 3,915,670 | 10/1975 | Lacey et al. | 48/197 R |

FOREIGN PATENT DOCUMENTS

| | | | |
|---|---|---|---|
| 787137 | 12/1972 | Belgium | 48/197 R |
| 798741 | 7/1958 | United Kingdom | 48/197 R |
| 1408134 | 10/1975 | United Kingdom | 48/214 A |

OTHER PUBLICATIONS

Royal, "Why Not Methanol as SNG Feedstock?", Pipeline and Gas Journal, Feb. 1973, pp. 58–62.

SNG Symposium I, "Substitute Natural Gas From Hydrocarbon Liquids", Institute of Gas Technology, Mar. 12–16, pp. 109–111.

*Primary Examiner*—Raymond N. Jones

*Assistant Examiner*—George C. Yeung

[57] ABSTRACT

Methanol is passed over a catalyst at an elevated temperature and pressure to produce a fuel gas containing a high proportion of methane in a one-step catalytic conversion process. Removal of water and carbon dioxide from the fuel gas produces a synthetic natural gas. For example, methanol with water is passed over a precious metal catalyst such as ruthenium on alumina at a temperature in the range of about 350° C. to 500° C. and a pressure in the range of about 800 to 2500 psig to produce a gaseous mixture comprising methane, carbon dioxide, minor amounts of hydrogen and essentially no carbon monoxide. Upon condensing the water vapor and scrubbing out the carbon dioxide, synthetic natural gas is obtained having a methane content above 90% by volume.

10 Claims, 1 Drawing Figure

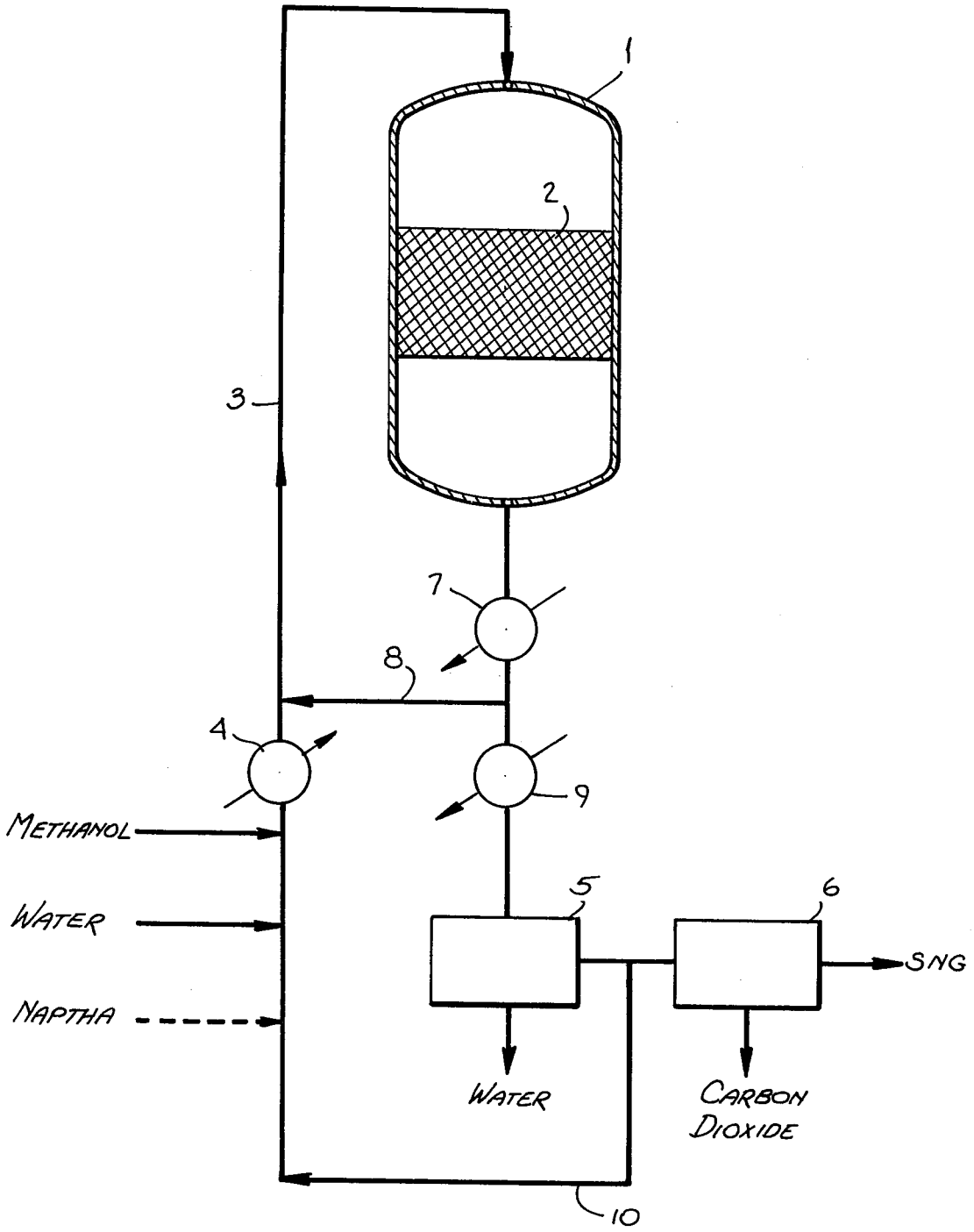
1
2
3
7
8
4
9
METHANOL
WATER
NAPTHA
5
6
SNG
WATER
CARBON DIOXIDE
10

PRODUCTION OF A FUEL GAS AND SYNTHETIC NATURAL GAS FROM METHANOL

This is a continuation of application Ser. No. 599,863, filed July 28, 1975, now abandoned.

BACKGROUND OF THE INVENTION

This invention relates to a process for the production of a fuel gas and more particularly to the single-step catalytic conversion of a methanol feedstock to synthetic natural gas.

Natural gas produced from oil wells located remotely from the ultimate user of the energy source was for many years burned or used at the site. With the developing shortage of fuel, attempts have been made to liquify the natural gas and to ship it in refrigerated tankers to the ultimate user. Such "flared gas" is however expensive to liquify and ship. It has been suggested that this gas might be more economically used by first converting it to methanol. The technology for doing this presently exists by reforming natural gas, primarily methane, with steam to form a synthetic gas, which may be carried out over a nickel catalyst. The resultant synthesis gas can be converted over catalysts such as zinc oxide-chromium oxide to produce methanol. The crude methanol can then be transported in conventional tankers to remote sources where it can be directly used for many purposes.

In addition, the growing shortage of oil and natural gas has placed greater importance on coal as a fuel source. However the direct use of coal presents many problems to its use as a fuel source. Therefore it is desirable to convert coal to other forms of fuel, which are more compatible with present day fuel consumption devices, which can be more easily handled, and which lead to fewer adverse ecological consequences. Coal can be subjected to partial oxidation in the presence of steam to produce a synthetic gas which can then be converted to methanol.

One proposed method for utilization of the methanol obtained from natural gas or coal is to reform it to produce synthetic natural gas. A conventional method for reforming the methanol is to do so at pressures of from about 100 to 300 psig to produce a product gas containing steam, methane, hydrogen, carbon monoxide and carbon dioxide. This product is then subject to reaction over a methanation catalyst to produce a synthetic natural gas consisting primarily of methane with a minor amount of hydrogen. This prior art two-step conversion can be represented as follows:

$$CH_3OH \rightarrow (a)CH_4 + (b)H_2 + (c)CO + (d)CO_2 + (e)H_2O$$

$$3H_2 + CO \rightarrow CH4 + H_2O$$

Another proposed method for making synthetic natural gas is to steam reform naphtha. The naphtha and steam are passed over a nickel containing catalyst bed to produce a mixture of methane (about 25% by volume), carbon monoxide, carbon dioxide and hydrogen. Thereafter, one or two steps of catalytic methanation are required to produce a synthetic natural gas having a higher percentage of methane.

Indeed, an extensive amount of literature exists on the production of methane from naphtha and other petroleum hydrocarbons. In general, the naphtha is converted at a high temperature over a nickel catalyst to a methane-rich gas which is then (after several optional intermediate steps) passed over a methanation catalyst at a lower temperature to bring about the formation of further amounts of methane by reaction between carbon dioxide, carbon monoxide and hydrogen present in the gas. The process may comprise passing a mixture of preheated hydrocarbons in vapor form and steam at atmospheric or superatmospheric pressure through a bed of a nickel catalyst such that the bed is maintained at temperatures in about the range 450° C. to 750° C. The resultant gases contain steam, hydrogen, carbon dioxide, carbon monoxide and methane. An example of such a process is to pass naphtha with steam (i.e., $H_2O$/-carbon mole ratio of 1.5 to 2.0) over a nickel catalyst at a pressure of 150 psig and an outlet gas temperature of 640° C. to provide a product having the following analysis (dry basis): methane 34.2%, hydrogen 38.7%, carbon monoxide 11.8% and carbon dioxide 13.3%. The amount of methane in this process is increased by passing the gaseous mixture over a second and optionally a third catalyst bed. The gases are usually cooled prior to methanation to a temperature which is sufficiently low for methane synthesis to occur to a substantial extent but which is not so low that there is insufficient catalytic activity for reaction to proceed at an adequate rate. In general, the temperature of the methanation reaction is within the range of about 200°–400° C. and at a pressure above that of the first stage, i.e. at 20–50 atmospheres or higher. This procedure can be used to change the first stage gaseous mixture to one having a final analysis (on a dry basis, and after scrubbing) of methane 96%, hydrogen 3.6% and carbon dioxide 0.4%. The methanation stages may be used, particularly to obtain a product having a greater percentage of methane. In such a process the gas from the first stage methanation is cooled prior to the second stage methanation since as methane is produced the temperature of the gases rise, i.e., the reaction is exothermic.

While it might be possible to utilize some of this technology in synthesizing methane from methanol, it shares with the above-described synthetic natural gas processes the marked disadvantage of requiring a minimum of two reaction stages to achieve the high methane/low hydrogen content of natural gas. This, of course, places demands on the equipment requirements.

It is accordingly an object of this invention to provide a one-step process for converting a methanol feed to a fuel gas containing a high proportion of methane.

A further object is to provide a process whereby synthetic natural gas can be produced from methanol in a one-step catalytic reaction.

Yet another object of this invention is to provide a process for converting a feed of methanol and naphtha to synthetic natural gas.

These and other objects will become apparent from the detailed description which follows.

THE INVENTION

This invention is directed to the procedure for forming a fuel gas, and particularly synthetic natural gas, from methanol by a one-step catalytic conversion process. The process of this invention is useful for preparing a synthetic natural gas having a methane content above about 90% as measured on a dry, carbon dioxide-free basis, and preferably about 98% or more methane, the remainder being essentially hydrogen. (Compositions of gaseous streams are stated in volume percentages). Other constituents are present in only small amounts; importantly, carbon monoxide is essentially non-existent and the feedstock is completely converted. Thus, the gas produced is similar to or interchangeable with natural gas and can be introduced into a natural gas transmission system.

In the process of this invention, vaporized methanol and preferably water vapor are contacted with a catalyst comprising one or more metals selected from Group VIII of the Periodic Table, particularly the platinum-group metals such as ruthenium, platinum and rhodium, on a suitable support such as a refractory oxide. The reaction is carried out at an elevated pressure and temperature, such as 300 to 5000 psig, and 200° C. to 550° C., preferably about 350° C. to 500° C. The resultant gaseous mixture comprises methane, carbon dioxide, steam, hydrogen and almost no carbon monoxide. The steam and usually carbon dioxide are removed from the mixture to obtain synthetic natural gas.

The overall reaction may be depicted as follows:

$$4CH_3OH \rightarrow 3CH_4 + CO_2 + 2H_2O$$

This composite reaction represents the overall reaction occurring within a single catalytic step.

DETAILED DESCRIPTION OF THE INVENTION

In the process of this invention, a vaporized feed comprised of methanol and water vapor is passed over a methanation catalyst. As discussed hereinafter, a gaseous recycle stream may be used to provide the water vapor and to aid in controlling the reaction temperature. Where the feed is obtained by vaporizing from the liquid state or where preheat of the feed is required, the maximum preheat or vaporization temperature is limited to some extent by the danger of thermal decomposition of the hydrocarbons but the temperature should be sufficiently high to maintain the methanol and water in a completely vaporized state when passed to the catalyst bed.

The source of the methanol feed is not critical to the conversion process of this invention and the earlier described natural gas and coal or other carbonaceous material reformation processes provide a suitable source of methanol. However, while the methanol product streams of those processes typically contain 90% or more methanol and therefore require purification for use by the chemicals industry, such impure feeds may be utilized in this invention.

The gases are contacted with the methanation catalyst at a temperature sufficient to maintain the reaction at an adequate rate. These temperatures will depend largely upon the particular catalyst employed, but the optimum temperatures are readily determinable within the ranges disclosed herein.

The methanation reaction from methanol is an exothermic one and operating conditions should be chosen to prevent the maximum exit temperature from exceeding 550° C. The lower limit for the reaction temperature is determined mainly by considerations of catalyst activity and typically is about 200° C. The exothermic temperature rise for a particular set of operating conditions will dictate in part the entrance temperature requirements and whether recycle is necessary to maintain the reaction below the 550° C. preferred maximum. In general it is found that the lower temperatures favor the reaction to methane subject to the requirement of a vaporized feed and temperatures sufficient to initiate reaction. Depending upon operating parameters, entrance or exit conditions may be more paramount in fixing the composition of the product gaseous mixture and are easily determinable within the disclosed ranges. As such, temperature conditions favoring methanation may be more important at, say, the exit and temperature control to that end via recycle, cooling, or low inlet temperatures can be practiced. Alternatively, low temperature inlet conditions can be employed in conjunction with the rise incident to the exothermic reaction subject to the preferred maximum exit temperature of 550° C. This type profile will minimize carbon deposition on the catalyst. In general, it appears that the exit conditions are more determinative of the product mixture composition.

A preferred temperature range for this process is between about 350° C. to 500° C.

The weight hourly space velocity (WHSV) of the reaction mixture across the catalyst bed may vary widely; it is usually maintained within a range of 1 to 100, and preferably within 3 to 40. These values represent the amount of methanol passed through the catalyst bed in terms of weight of methanol per weight of catalyst, per hour.

The pressure at which the catalytic reaction is conducted is within the range of 300 psig to about 5000 psig. A preferred range is between about 800 to 2500 psig and most preferably from 1000 to 1500 psig. In general, the higher pressures favor the conversion to methane.

The catalyst utilized in the methanation process of this invention comprises an active component distributed on a support and should be more active than those generally used for hydrocarbon reforming. The catalyst comprises one or more metals selected from Group VIII of the Periodic Table. Preferred among catalysts for this invention are nickel or a precious metal of Group VIII, i.e. platinum, palladium, ruthenium, rhodium, osmium and iridium used singly or in combination. Ruthenium and nickel have been found very useful. Other metals and metal mixtures can however be used, for example cobalt alone or in mixtures similar to those in which nickel is used. Metals of Group I, VI and VII may also be employed in admixture with the foregoing metals of Group VIII of the Periodic Table.

The catalytic metal is normally distributed on a refractory inorganic oxide support. Alumina is a suitable support. In addition, a stabilized alumina may be used such as ceria- or thoria-stabilized alumina. Other refractory oxide supports, such as admixtures of alumina and silica, magnesia and zirconia can be used. Generally, highly acidic supports should be avoided to reduce problems of coke formation. The catalytically active metal can also be supported on a zeolite material, synthetic or natural, which may be mixed with other inorganic oxides. Alkaline earth metal oxides can be used with one or more of the foregoing refractory materials to form a thermally stable mixed oxide.

The proportion of the catalytically active metal in the catalyst composition typically depends on whether it is a base metal or a precious metal. Using base metals the proportion is, for example, from about 3 to 80 weight %, especially 5 to 50% calculated as the weight of metal oxide on the catalyst composition. Using only one or more precious metals, the proportion is between about 0.01 to 20%, preferably 0.1 to 5%, calculated as the metal on the catalyst composition. Using mixtures of base and precious metals the amount of each, and particularly the amount of precious metals, may be reduced.

The catalytically active metal may be incorporated with the inorganic oxide support in accordance with methods well known in the art for the preparation of methanation catalysts. For example a catalytically active metal may be coprecipitated with a refractory insoluble compound, followed by calcination to convert the coprecipitated compounds to oxides, and finally the catalyst composition is reduced to its active state. This procedure can be used with nickel and aluminum salts, to which, after reduction to an active state a minor proportion of an oxide, hydroxide or carbonate of an alkali or alkaline earth metal is added.

The precious metal or its salt may be mixed with a finely divided refractory support which is then suitably shaped and calcined and the oxide of the metal then reduced.

The catalyst may be used in the normal type of fixed bed which may be in the form of a tubular reactor or with internal cooling tubes to facilitate temperature control. The catalyst is in any one of the conventional forms such as granules, pellets, beads, rings, cylinders, extrusions, and microspheres. Alternatively a moving bed such as a fluidized bed of catalysts can be used, either with or without conventional internal cooling tubes in the bed. Fluidization is maintained by the passage of reactants through the bed.

The present conversion process does not require a feed containing water vapor in order for the reaction to proceed satisfactorily, particularly at temperatures below about 350° C., since the reaction itself produces water. The presence of water (steam) is known by the art to minimize the deposition of carbon on the catalyst, which deposition reduces catalyst activity, and typical processes require a molar excess of steam in the feed, generally 2 to 3 moles per mole of methanol. While such quantities may be utilized in the present process, the process of the present invention requires no such quantities of water. Where water is present in the feed, carbon deposition can be reduced using low steam/methanol ratios, generally on the order of 0.5 to 1.5 moles steam per mole of methanol. High steam/methanol ratios may result in premature catalyst degradation due to sintering. Thus, the ability to operate the present conversion process at low steam levels is desirable. The low steam/methanol ratio also contributes to the ability to meet the high methane requirements of a synthetic natural gas in a single-step conversion process.

The presence of the above-mentioned proportion of water vapor is preferred in the process of this invention particularly to prevent carbon deposition at the initial stages of the reaction, i.e., prior to the formation of reaction water. As is hereinafter described, the requisite water vapor can be supplied by including in the vaporized feed a recycled portion of the product mixture exiting from the catalyst reaction zone. Water vapor is also useful in controlling the temperature of this exothermic reaction.

The attached FIGURE presents a schematic illustration of the process of this invention wherein a vaporized feed comprised of methanol (optionally with naphtha) and water are fed to a chamber containing a catalyst which reforms the product to produce a high proportion of methane. The water and carbon dioxide are separated from the reformed product by conventional techniques to produce a natural gas containing a minor amount of hydrogen and essentially no carbon monoxide. The equipment requirements for this process are minimal and are significantly less than that for the conventional multi-stage reactors.

In the FIGURE an experimental tubular reactor 1, is shown which contains a catalyst bed 2, supported in a conventional manner. Methanol and water (or steam), and optionally naphtha, are introduced into reactor 1 via line 3. Heat exchanger 4 serves to vaporize the feed mixture and heat it to the desired reactor inlet temperature. The gaseous mixture is reformed as it passes through the reactor and exits at its bottom portion. The vaporization, and elevation in temperature, of the methanol-water mixture is also, in part, effected by the heat generated by the reaction in the reactor, and in turn, this vaporization assists in controlling the temperature in the reactor. The gaseous mixture exits from the reactor and passes through a cooler or condensing means into water separator 5. The removal of water can be carried out by cooling the gaseous mixture to condense the water. In a full scale unit the high pressure of the gaseous product mixture may also be used to drive a turbine to do useful work, such as driving pumps to feed the methanol and water to the reactor. The gaseous product mixture is then passed through a carbon dioxide scrubber, 6, to obtain the synthetic natural gas. A typical purification comprises passing the gases over hot potassium carbonate to scrub out the carbon dioxide. Alternatively the pressure of the gaseous mixture in the reactor can be raised sufficiently high to liquify the carbon dioxide and to facilitate its removal for use in this form. The high pressure gaseous mixture which remains can then be used to drive a turbine to provide some of the energy used for accessory equipment for the process. The pressure of the gaseous mixture even after its use to drive turbines for accessory equipment can be sufficiently high to feed the gases into a high pressure distribution system such as that for the distribution of natural gas.

In a preferred embodiment of this invention a portion of a gaseous product mixture is recycled to the reactor inlet as a component of the vaporized feed to control the reaction temperature, and to provide water vapor and hydrogen which extends the catalyst life. The reactor gas is passed through a first cooling means 7 to remove heat, decreasing its temperature to a suitable level so that it may be recycled as stream 8 to the feed inlet. The recycling of the reactor gas increases the water vapor content in the reactor, which acts to prevent coking. By obtaining the bulk of the water from stream 8, where the water is in vapor form, additional energy is not required to vaporize water. The gases from the first cooling means are then passed through a second cooling means 9 and to the water separator 5. A second recycle stream 10 also recycles the reactor gases back to the reactor inlet but at a lower temperature and with a reduced water content. The ratio of total recycle to the vaporized methanol feed gas in stream 3 can be varied to control temperature in the catalyst. By adjusting the relative amounts of recycle gases in stream 8 and 10, the optimum amount of water can be achieved while maximizing the preheat given to the fresh methanol feed. The temperature control obtained is both a function of the relative amounts of streams 8 and 10 and their respective temperatures. The amount of recycle from stream 8 is typically from about 25 to 100% of the total recycle gas.

As earlier indicated, the vaporized methanol feed may further comprise naphtha. In this alternative procedure, shown by the broken line in the FIGURE, a mixture of methanol, water and naphtha may be fed to the reactor under the same conditions described above. In this process, when the amount of methanol is substantially or significantly reduced in amount, it is important to recycle to the reactor, with the feed stream, a portion of the gaseous mixture to assist in the prevention of carbon deposition and to effectively utilize the hydrogen formed in the gasification reaction.

The vaporized methanol feed may, of course, contain other components capable of single-step conversion to methane.

When using methanol alone or in combination with a naphtha feed it is preferable to ensure that the feed has a minimum sulfur content to prevent poisoning of the catalyst. The removal of sulfur may be effected by any known process, for example, by reduction of the sulfur by reducing gas to hydrogen sulfide over a metal catalyst, followed by removal of the hydrogen sulfide by scrubbing. It is desirable that the sulfur content of the feedstock is below about one part per million, preferably below about 0.1 part per million. The sulfur content of the feed water should also be controlled to maintain a comparably low level.

The FIGURE, as described above schematically shows small-scale equipment for carrying out the process of this invention. The foregoing principles are readily applicable to the design of large-scale equipment in accordance with well known techniques. In particular, for tubular reactors the catalyst concentration could vary vertically (with a lower concentration at the inlet) and boiler-feed water under pre-set pressures would be used to maintain control to prevent the exothermic reaction for raising the temperature too high. The water used to control the temperature is then available as a superheated high pressure steam for further use, which improves the overall economic and thermal efficiency of the process. The exit gas can be used to heat and vaporize the inlet feed by passing them in a conventional heat-exchange arrangement.

The following examples further illustrate this invention.

EXAMPLE I

In this run, the catalyst comprised 0.5% ruthenium on alumina pellets (14–20 mesh) prepared according to conventional procedures. A methanol/water mixture comprising one mole of methanol for each 0.5 moles of water was fed to a preheater and vaporized. This feed mixture was passed over the catalyst at 400° C. inlet temperature and 1100 psig. About 5 cc. of catalyst was employed. The results of this run are summarized in the following table.

TABLE I

| Run Duration (hrs.) | Product Composition, Vol. % (Dry Basis) | | | |
|---|---|---|---|---|
| | $CH_4$ | $CO_2$ | $H_2$ | Other |
| 4 | 71.0 | 22.8 | 3.3 | Balance |
| 51 | 71.0 | 23.0 | 3.4 | Balance |

Carbon monoxide was not detected in the product composition. The balance materials were believed to be hydrocarbons and/or air. Conversion of the methanol was approximately 100% and no ethers were detected.

EXAMPLE II

The catalyst for these runs was 7.5 cc of 14–20 mesh 0.5% ruthenium on alumina. This was diluted with 242.5 cc of alpha alumina, charged to a tubular reactor and reduced at 500° C. for 4 hours with hydrogen. After reduction of the catalyst, the temperature was lowered to 400° C. and the reactor was pressurized with hydrogen to the desired operating pressure. The mole ratio of steam to methanol was 1.5:1, the feed rate was 14 cc methanol/hour/cc catalyst, and the reactor inlet temperature was 400° C. Results are given in the following table.

TABLE II

| Run Duration (hrs.) | Pressure (psig) | Product composition Volume % (dry basis) | | | | |
|---|---|---|---|---|---|---|
| | | $CH_4$ | $CO_2$ | CO | $H_2$ | Other |
| 2 | 300 | 50.0 | 23.5 | 0.2 | 20.2 | 6.1 |
| 10 | 500 | 62.0 | 21.8 | trace | 11.2 | 5.0 |
| 13 | 1100 | 68.5 | 24.0 | N.D. | 5.0 | 2.5 |
| 4 | 1600 | 70.0 | 23.5 | N.D. | 4.3 | 2.2 |

As indicated, carbon monoxide was essentially nonexistant in these runs. Conversion of methanol was about 100% and no ethers were detected. The compounds designated as "other" were believed to be hydrocarbons and/or air.

EXAMPLE III 7.5 cc of 14–20 mesh 60% nickel on alumina was diluted with 242.5 cc of alpha alumina and reduced at 500° C. for 6 hours with hydrogen. At 400° C. and 1100 psig, vaporized methanol and water (1.5 moles steam per mole methanol) was passed over the catalyst at the same rate as in Example II. After 135 hours, methanol had yet to appear in the product mixture. The product composition was on a volume, dry basis: 69% $CH_4$, 22.7% $CO_2$, 0% CO, 5.3% $H_2$ and 3.0% other materials.

The gas mixtures shown can be used directly as fuel gases or are converted to a high quality synthetic natural gas upon removing the carbon dioxide. As these runs show, the process of this invention produces a synthetic natural gas, consisting essentially of methane with relatively minor amounts of hydrogen and little or no detectable amounts of carbon monoxide. The synthetic natural gas has a heating value of about 1000 BTU/ft.$^3$. The hydrogen content in the final product is preferable maintained below about 5% and advantageously below about 2% by volume; greater amounts tend to produce a high flame speed and a too rapid burning of the gas. Carbon monoxide in the gas presents a safety hazard and is indicative of inefficiency in the conversion reaction.

This invention has been described in terms of specific embodiments set forth in detail. Alternative embodiments will be apparent to those skilled in the art in view of this disclosure, and accordingly such modifications are to be contemplated within the spirit of the invention as disclosed and claimed herein.

Having thus described the invention, what is claimed is:

1. A single-stage catalytic process for making a fuel gas, said process comprising passing a gaseous feed comprised of methanol and steam, in a reactor, over a catalyst comprised of Group VIII metal on a support at a pressure in the range of from about 800 psig to about 2500 psig and a temperature in the range of from about 350° C. to about 500° C., maintaining said gaseous feed in a completely vaporized state while passing said gaseous feed through said reactor whereby said gaseous feed is reformed entirely in the vapor phase to a gaseous product mixture containing at least about 90% methane by volume on a dry carbon dioxide-free basis.

2. The process of claim 1 wherein said catalyst is selected from the group consisting of nickel, platinum, palladium, rhodium, ruthenium and mixtures thereof on a refractory inorganic oxide support.

3. The process of claim 2 wherein said catalyst comprises ruthenium.

4. The process of claim 2 wherein said catalyst comprises nickel.

5. The process of claim 2 wherein said steam is present in a ratio in the range of from about 0.5 to about 1.5 moles steam for each mole of methanol.

6. The processs of claim 1 wherein said steam is present in a ratio in the range of from about 0.5 to about 1.5 moles steam for each mole of methanol.

7. The process of claim 1 wherein said gaseous feed contains at least a portion of said gaseous product mixture recycled thereto.

8. The process of claim 7 wherein steam is first removed from said portion of gaseous product mixture.

9. The process of claim 1 wherein said temperature is in the range of from about 380° C. to about 420° C.

10. The process of claim 1 wherein said pressure is in the range of from about 1100 psig to about 1600 psig.

* * * * *